US009193086B2

(12) United States Patent
Jacko et al.

(10) Patent No.: US 9,193,086 B2
(45) Date of Patent: Nov. 24, 2015

(54) APPARATUS FOR CUTTING FOOD PRODUCTS

(71) Applicant: Urschel Laboratories Inc., Valparaiso, IN (US)

(72) Inventors: Michael Scot Jacko, Valparaiso, IN (US); Scott Alan Klockow, Kouts, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 0 days.

(21) Appl. No.: 14/242,377

(22) Filed: Apr. 1, 2014

(65) Prior Publication Data

US 2014/0290451 A1 Oct. 2, 2014

Related U.S. Application Data

(60) Provisional application No. 61/807,747, filed on Apr. 2, 2013.

(51) Int. Cl.

| | |
|---|---|
| ***B26D 7/06*** | (2006.01) |
| ***B26D 1/03*** | (2006.01) |
| ***B26D 7/26*** | (2006.01) |

(52) U.S. Cl.

CPC ..... *B26D 7/2614* (2013.01); *B26D 1/03* (2013.01); *B26D 7/0691* (2013.01); *B26D 7/2628* (2013.01); *Y10T 83/04* (2015.04); *Y10T 83/6473* (2015.04)

(58) Field of Classification Search

CPC ..... B26D 1/03; B26D 7/2614; B26D 7/0691; B26D 7/2628; Y10S 83/932; C13B 5/08

USPC ..... 83/13, 403, 699.51, 932, 698.41, 858, 83/698.51, 598.61, 699.61, 165, 663, 591, 83/594, 595, 596, 703; 30/280, 281, 339, 30/334; 241/89.3, 84, 85, 242, 285.1, 241/285.2

See application file for complete search history.

(56) References Cited

U.S. PATENT DOCUMENTS

| | | | | |
|---|---|---|---|---|
| 2,884,974 | A * | 5/1959 | Woodward, Jr. | 83/403 |
| 3,139,128 | A * | 6/1964 | Urschel et al. | 83/111 |
| 3,605,840 | A * | 9/1971 | Morrett | 83/425.3 |
| 3,774,490 | A * | 11/1973 | Gerson | 83/425.3 |
| 3,807,266 | A * | 4/1974 | Camp | 83/404.4 |
| 5,694,824 | A * | 12/1997 | Jacko et al. | 83/403 |
| 6,968,765 | B2 * | 11/2005 | King | 83/403 |
| 7,178,440 | B2 | 2/2007 | Bucks | |
| 2002/0170991 | A1 | 11/2002 | Prewitt et al. | |

FOREIGN PATENT DOCUMENTS

| | | |
|---|---|---|
| WO | 96-01148 | 1/1996 |

* cited by examiner

*Primary Examiner* — Ghassem Alie

(74) *Attorney, Agent, or Firm* — Hartmen Global IP Law; Gary M. Hartman; Michael D. Winter

(57) ABSTRACT

Methods and apparatus suitable for cutting food product. The apparatus includes an annular-shaped cutting head and an impeller coaxially mounted within the cutting head for rotation about an axis of the cutting head in a rotational direction relative to the cutting head. The cutting head has lower and upper structural members, circumferentially-spaced support segments between the lower and upper structural members, and at least one knife assembly located at a perimeter of the cutting head adjacent a corresponding one of the support segments. The knife assembly includes a holder having a slot, a knife partially received within the slot, and tensioning means for inducing a longitudinal tension in the knife.

17 Claims, 14 Drawing Sheets

74b
88
88
74b
74b
88
74
74
74

APPARATUS FOR CUTTING FOOD PRODUCTS

CROSS REFERENCE TO RELATED APPLICATIONS

This application claims the benefit of U.S. Provisional Application No. 61/807,747, filed Apr. 2, 2013, the contents of which are incorporated herein by reference.

BACKGROUND OF THE INVENTION

The present invention generally relates to methods and equipment for cutting food products. More particularly, this invention relates to apparatuses equipped with at least one knife suitable for cutting food product slices, wherein the knife is tensioned so as to be sufficiently rigid to slice a food product, for example, a potato.

Various types of equipment are known for slicing, shredding and granulating food products, such as vegetable, fruit, dairy, and meat products. A widely used line of machines for this purpose is commercially available from Urschel Laboratories, Inc., under the name Urschel Model CC®, an embodiment of which is represented in FIG. 1. The Model CC® machine line provides versions of centrifugal-type slicers capable of producing uniform slices, strip cuts, shreds and granulations of a wide variety of food products at high production capacities.

FIGS. 2 and 3 are perspective views of an impeller 10 and cutting head 12, respectively, of types that can be used in the Model CC® machine of FIG. 1. In operation, the impeller 10 is coaxially mounted within the cutting head 12, which is generally annular-shaped with cutting knives 14 mounted on its perimeter. The impeller 10 rotates within the cutting head 12, while the latter remains stationary. Each knife 14 projects radially inward toward the impeller 10 in a direction generally opposite the direction of rotation of the impeller 10, and defines a cutting edge at its radially innermost extremity. As represented in FIG. 2, the impeller 10 has generally radially-oriented paddles 16 with faces that engage and direct food products (e.g., potatoes) radially outward against the knives 14 of the cutting head 12 as the impeller 10 rotates.

FIG. 1 schematically represents the cutting head 12 mounted on a support ring 28 above a gear box 30. A housing 32 contains a shaft coupled to the gear box 30, through which the impeller 10 (not shown) is driven within the cutting wheel 12. Further descriptions pertaining to the construction and operation of Model CC® machines are contained in U.S. Pat. Nos. 5,694,824 and 6,968,765, the entire contents of which are incorporated herein by reference.

The cutting head 12 shown in FIG. 3 comprises a lower support ring 18, an upper support ring 20, and circumferentially-spaced support segments (shoes) 22. The knives 14 of the cutting head 12 are individually secured with clamping assemblies 26 to the shoes 22. Each clamping assembly 26 includes a knife holder 26A mounted to the radially inward-facing side of a shoe 22, and a clamp 26B mounted on the radially outward-facing side of a shoe 22 to secure the knife 14 to the knife holder 26A. The shoes 22 are represented as being secured with bolts 25 to the support rings 18 and 20. The shoes 22 are equipped with coaxial pivot pins (not shown) that engage holes in the support rings 18 and 20. By pivoting on its pins, the orientation of a shoe 22 can be adjusted to alter the radial location of the cutting edge of its knife 14 with respect to the axis of the cutting head 12, thereby controlling the thickness of the sliced food product. As an example, adjustment can be achieved with an adjusting screw and/or pin 24 located circumferentially behind the pivot pins. FIG. 3 further shows optional gate insert strips 23 mounted to each shoe 22, which the food product crosses prior to encountering the knife 14 mounted to the succeeding shoe 22.

The knives 14 shown in FIG. 3 are depicted as having straight cutting edges for producing flat slices, though other shapes are also used to produce sliced and shredded products. For example, the knives 14 can have cutting edges that define a periodic pattern of peaks and valleys when viewed edgewise. The periodic pattern can be characterized by sharp peaks and valleys, or a more corrugated or sinusoidal shape characterized by more rounded peaks and valleys when viewed edgewise. If the peaks and valleys of each knife 14 are aligned with those of the preceding knife 14, slices are produced in which each peak on one surface of a slice corresponds to a valley on the opposite surface of the slice, such that the slices are substantially uniform in thickness but have a cross-sectional shape that is characterized by sharp peaks and valleys (AV-slices@) or a more corrugated or sinusoidal shape (crinkle slices), collectively referred to herein as periodic shapes. Alternatively, shredded food product can be produced if each peak of each knife 14 is aligned with a valley of the preceding knife 14, and waffle/lattice-cut food product can be produced by intentionally making off-axis alignment cuts with a periodic-shaped knife, for example, by cross-cutting a food product at two different angles, typically ninety degrees apart. Whether a sliced, shredded or waffle-cut product is desired will depend on the intended use of the product.

Equipment currently available for cutting food product, such as those represented in FIGS. 1-3, are well suited for producing slices of a wide variety of food products. Even so, further improvements are desirable, particularly if capable of improving the quality of a food product. For example, it is often desirable to reduce levels of surface cracking, through-slice cracking, and surface roughness of sliced, shredded, and waffle-cut food products. As a particular example, if a sliced, shredded, or waffle-cut food product is intended for chips, for example, potato chips, surface cracks can undesirably lead to increased oil consumption, damaged starch cells, yield loss (starch does not stay in the chip), etc.

BRIEF DESCRIPTION OF THE INVENTION

The present invention provides methods and equipment suitable for cutting food product.

According to one aspect of the invention, an apparatus adapted to cut food products includes an annular-shaped cutting head and an impeller coaxially mounted within the cutting head for rotation about an axis of the cutting head in a rotational direction relative to the cutting head. The cutting head has lower and upper support members, circumferentially-spaced support segments between the lower and upper support members, and at least one knife assembly located at a perimeter of the cutting head adjacent a corresponding one of the support segments. The knife assembly includes a holder having a slot, a knife partially received within the slot, and tensioning means for inducing a longitudinal tension in the knife.

Other aspects of the invention includes methods of operating the apparatus described above to cut food products.

Technical effects of the method and apparatus described above preferably include the ability to tension a knife to be sufficiently rigid to cut a food product without requiring conventional support hardware, such as an assembly comprising a clamp for securing a knife to a knife holder. A food product cut by a knife secured with a clamp must ordinarily pass over the clamp as it exits the knife, which can result in surface cracks, through-slice cracks, and increased surface roughness of the product. Consequently, the elimination of conventional clamping hardware offers the possibility for avoiding these undesired effects.

Other aspects and advantages of this invention will be better appreciated from the following detailed description.

DETAILED DESCRIPTION OF THE INVENTION

Figure 1:
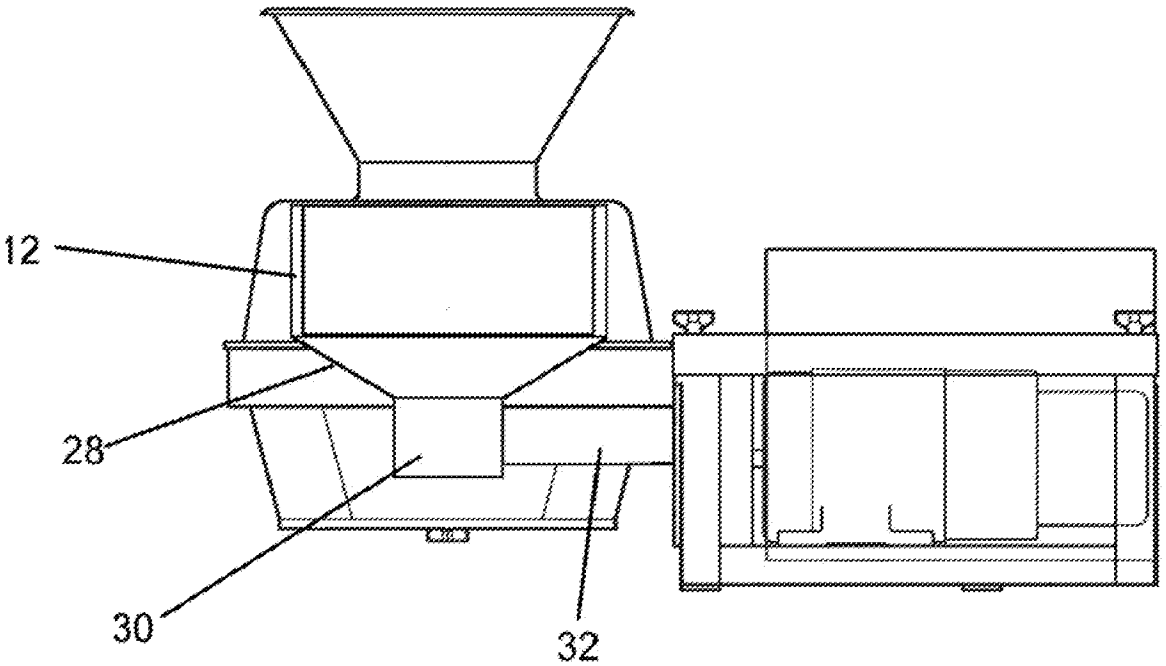
FIG. 1 (Prior Art)
FIG. 1 is a side view in partial cross-section representing a cutting apparatus known in the art.

FIGS. 4 through 7 represent views of an annular-shaped cutting head 50 of a type that can be used with a cutting apparatus, for example, the apparatus represented in FIG. 1, to produce a variety of food products, including chips from potatoes, and to methods of producing sliced, shredded, or waffle-cut food products with such a cutting head. The non-limiting embodiment of the cutting head 50 shown in FIGS. 4 through 7 is particularly adapted to cut food products into slices. Although the cutting head 50 will be described herein with specific reference to cutting food products, it is foreseeable that the cutting head 50 could be used for cutting other materials, and therefore the scope of the invention should not be limited to food products.

Figure 2:
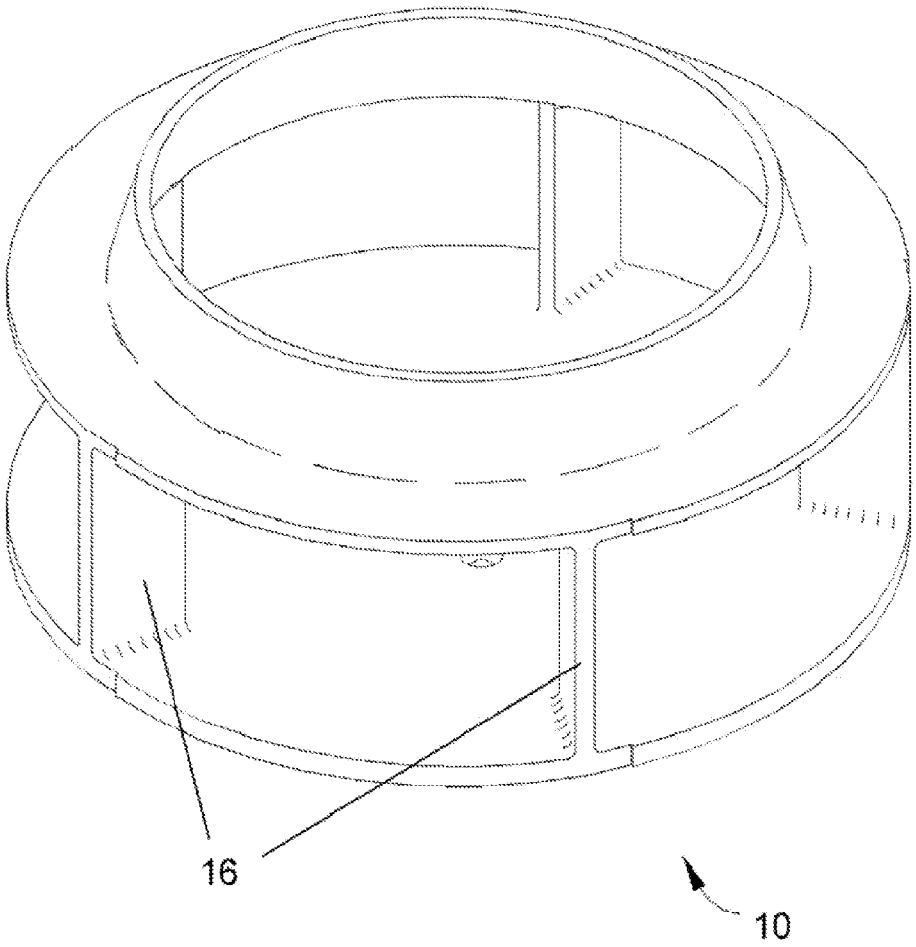
FIG. 2 (Prior Art)
FIG. 2 is a perspective view representing an impeller of a type suitable for use with the cutting apparatus of FIG. 1.
Figure 3:
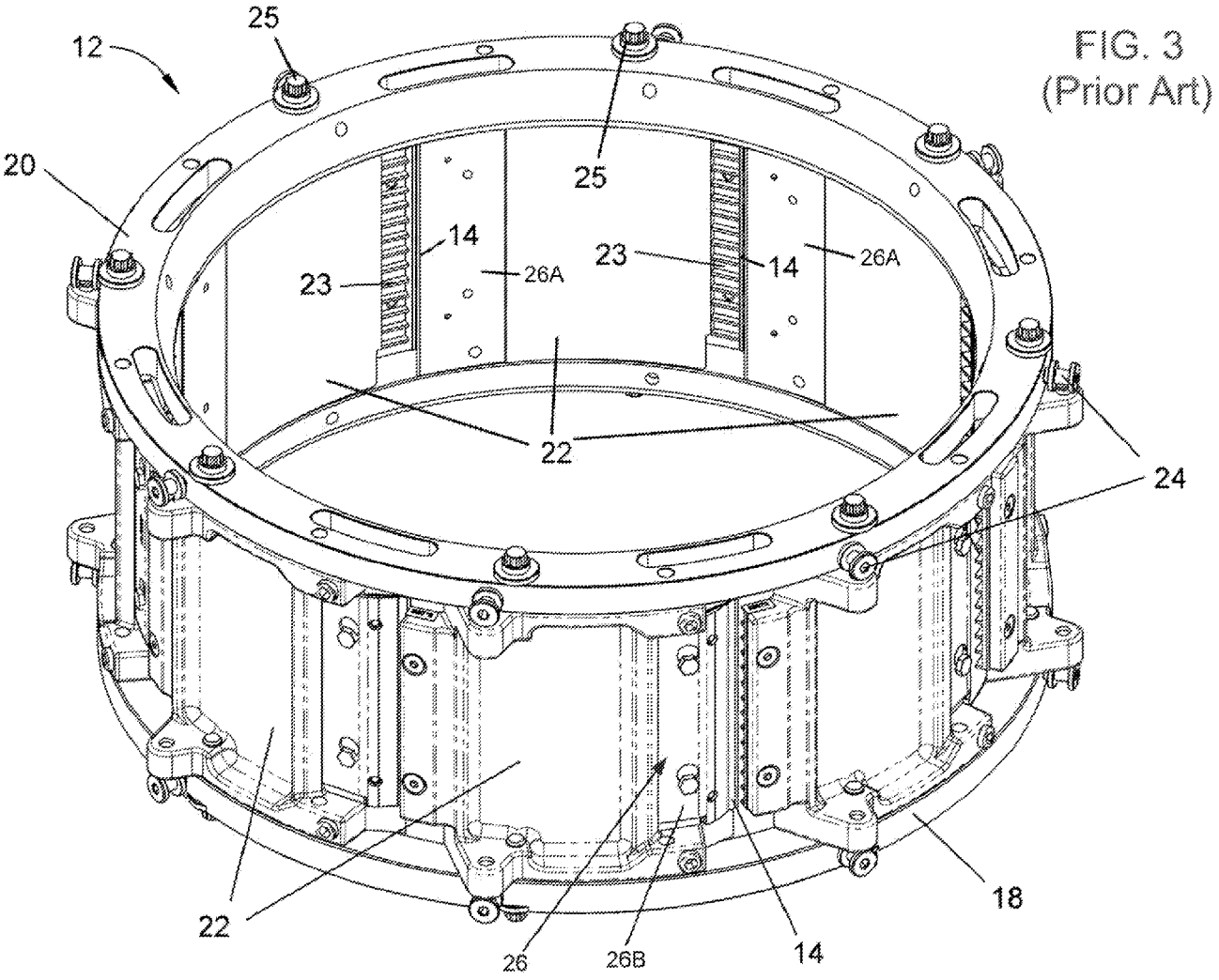
FIG. 3 (Prior Art)
FIG. 3 is a perspective view representing a cutting head of a type suitable for use with the cutting apparatus of FIG. 1 and the impeller of FIG. 2.
Figure 4:
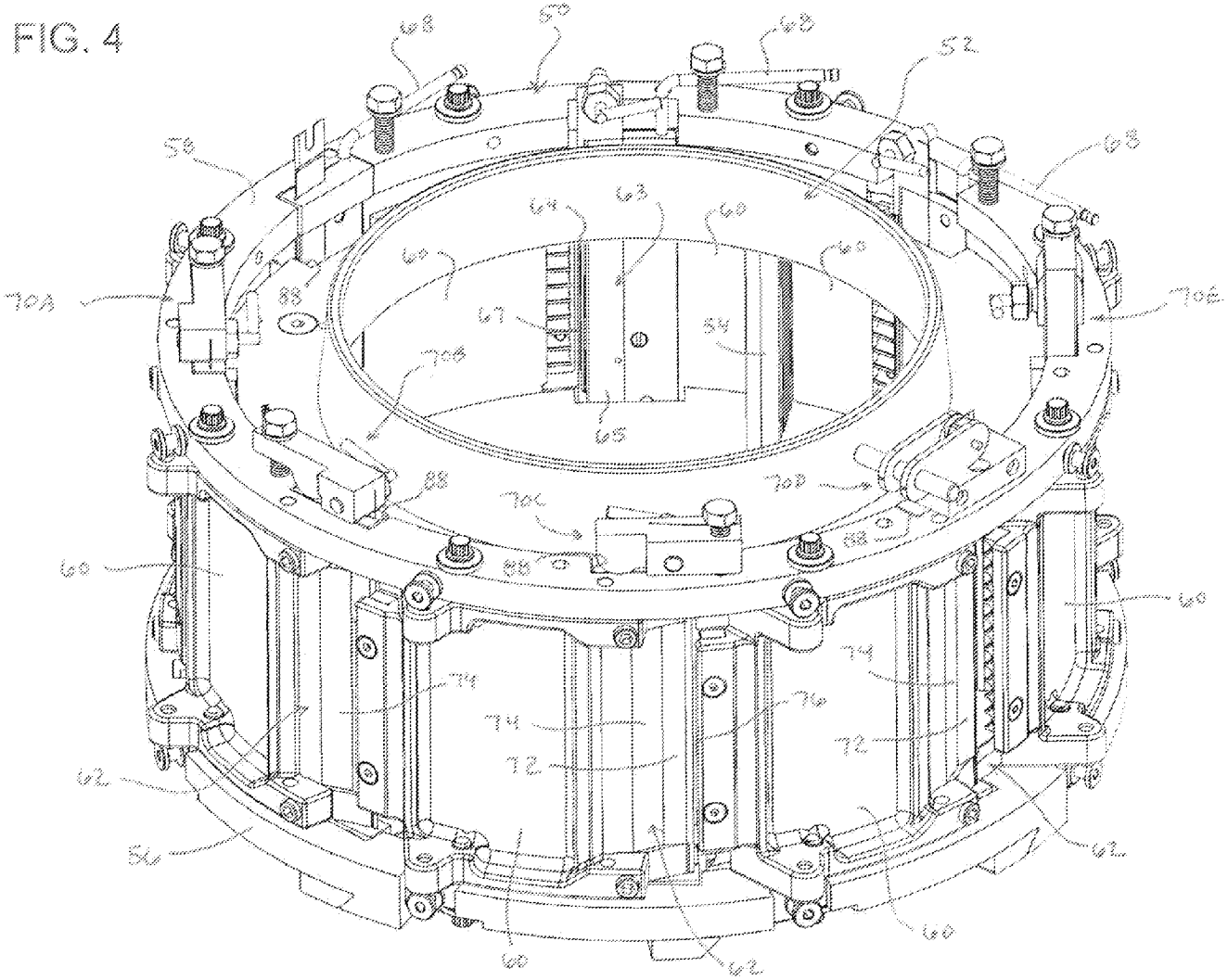
FIG. 4 is a perspective view representing a cutting apparatus comprising an impeller assembled within a cutting head, the latter of which comprises knife holders and knife tensioning devices.
Figure 5:
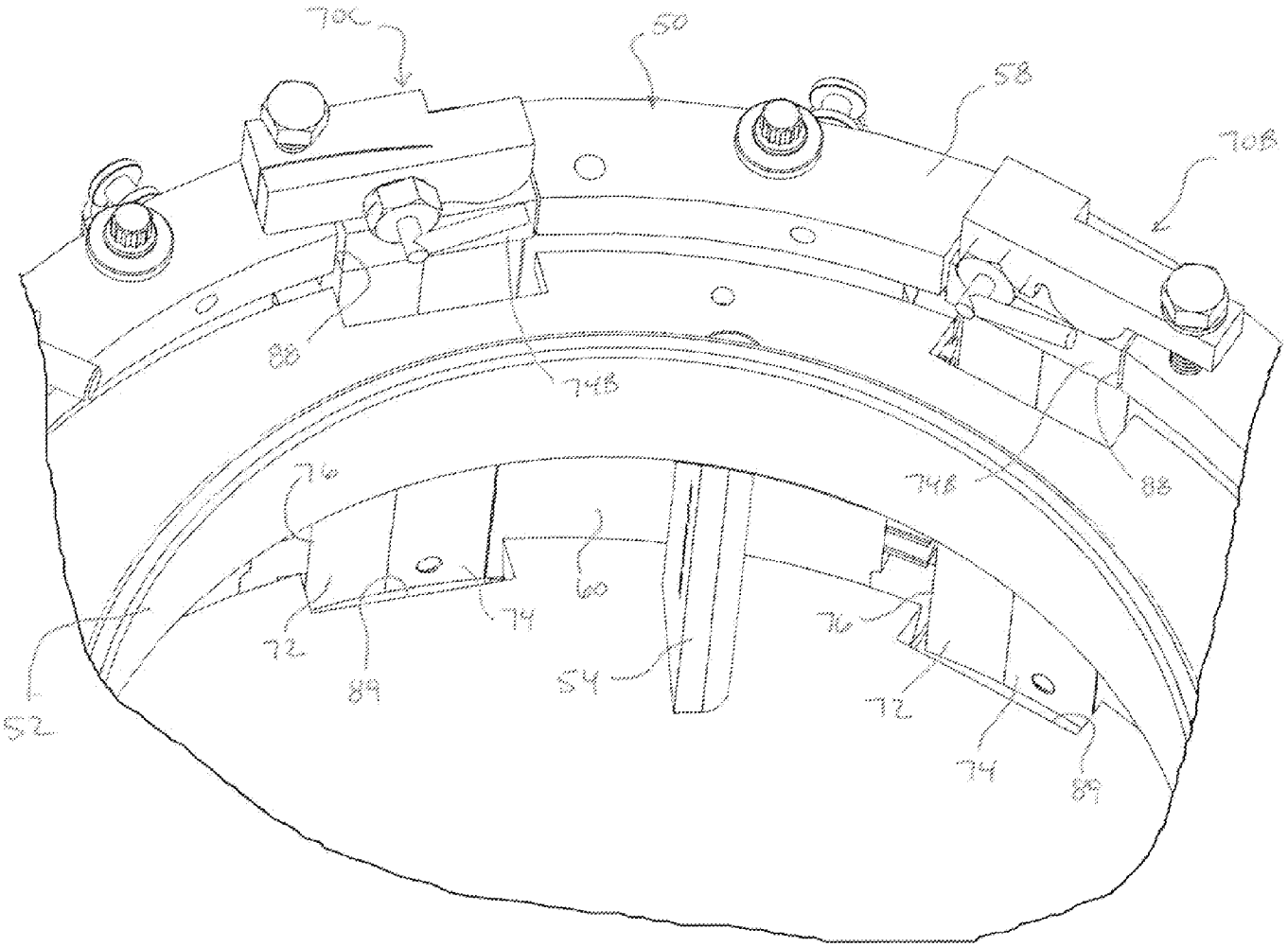
FIG. 5 is a perspective view showing an interior region of the cutting apparatus of FIG. 4.
Figure 6:
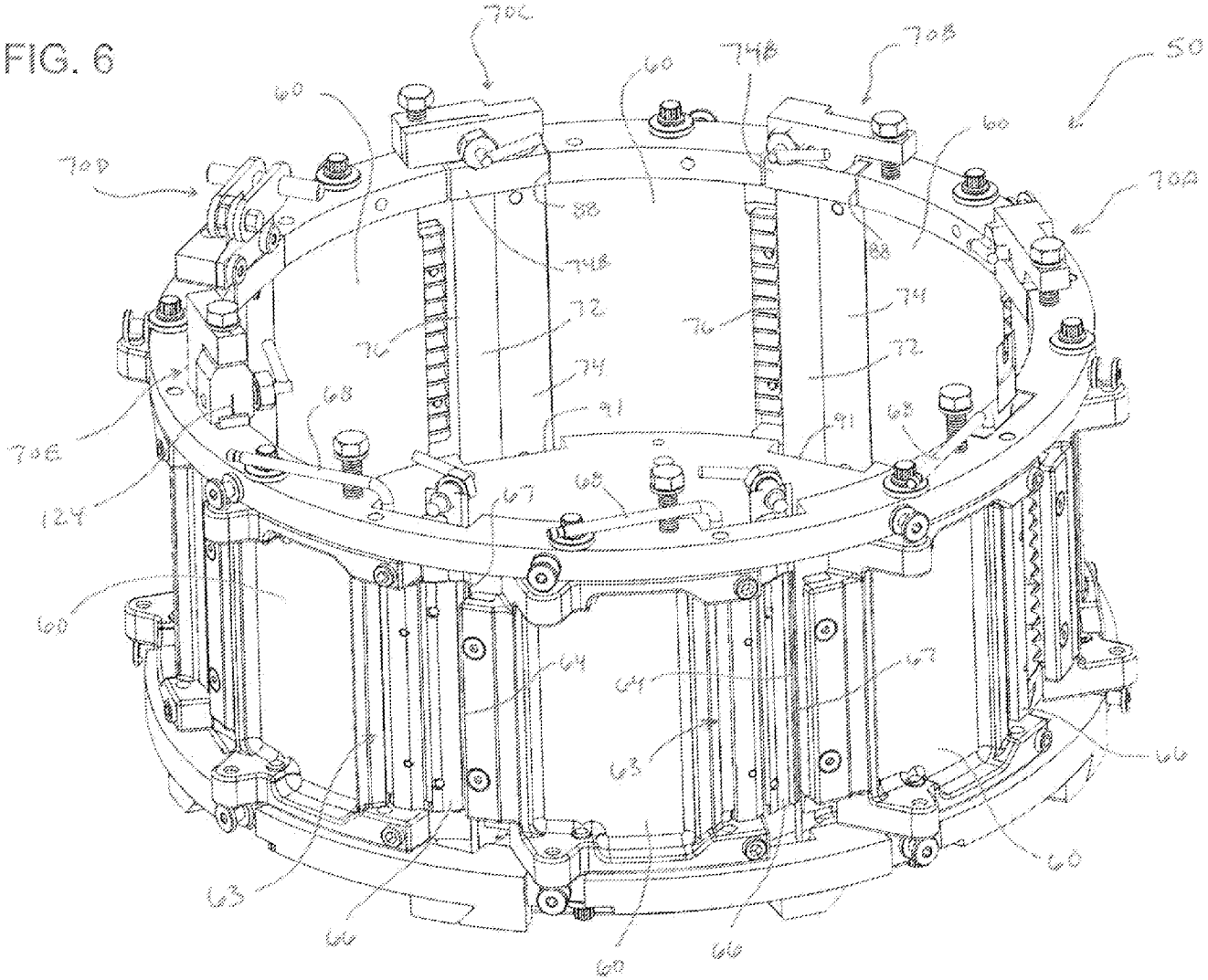
FIG. 6 is a perspective view showing the cutting header of FIG. 4 without the impeller.

FIGS. 4 and 5 represent a cutting apparatus comprising the cutting head 50 and an impeller 52 coaxially mounted within the cutting head 50. As was discussed in reference to the prior art of FIGS. 1-3, the cutting head 50 is stationary and the impeller 52 rotates within the cutting head 50 about an axis of the cutting head 50 and in a rotational direction relative to the cutting head 50. The impeller 52 comprises at least one paddle 54, and preferably multiple paddles 54 circumferentially spaced along a perimeter thereof for delivering food product radially outward toward the cutting head 50. The cutting head 50 and impeller 52 are represented in FIGS. 4 through 6 as being similar in general construction to the cutting head 12 and impeller 10 of FIGS. 2 and 3, and in combination the cutting head 50 and impeller 52 can be used in various types of machines including that represented in FIG. 1. In view of similarities between the cutting head 50 and impeller 52 of FIGS. 4 through 6 and the cutting head 12 and impeller 10 of FIGS. 2 and 3, the following discussion will focus primarily on certain aspects of the cutting head 50 and impeller 52, whereas other aspects not discussed in any detail may be, in terms of structure, function, materials, etc., essentially as was described for the cutting head 12 and impeller 10 of FIGS. 2 and 3.

Figure 7:
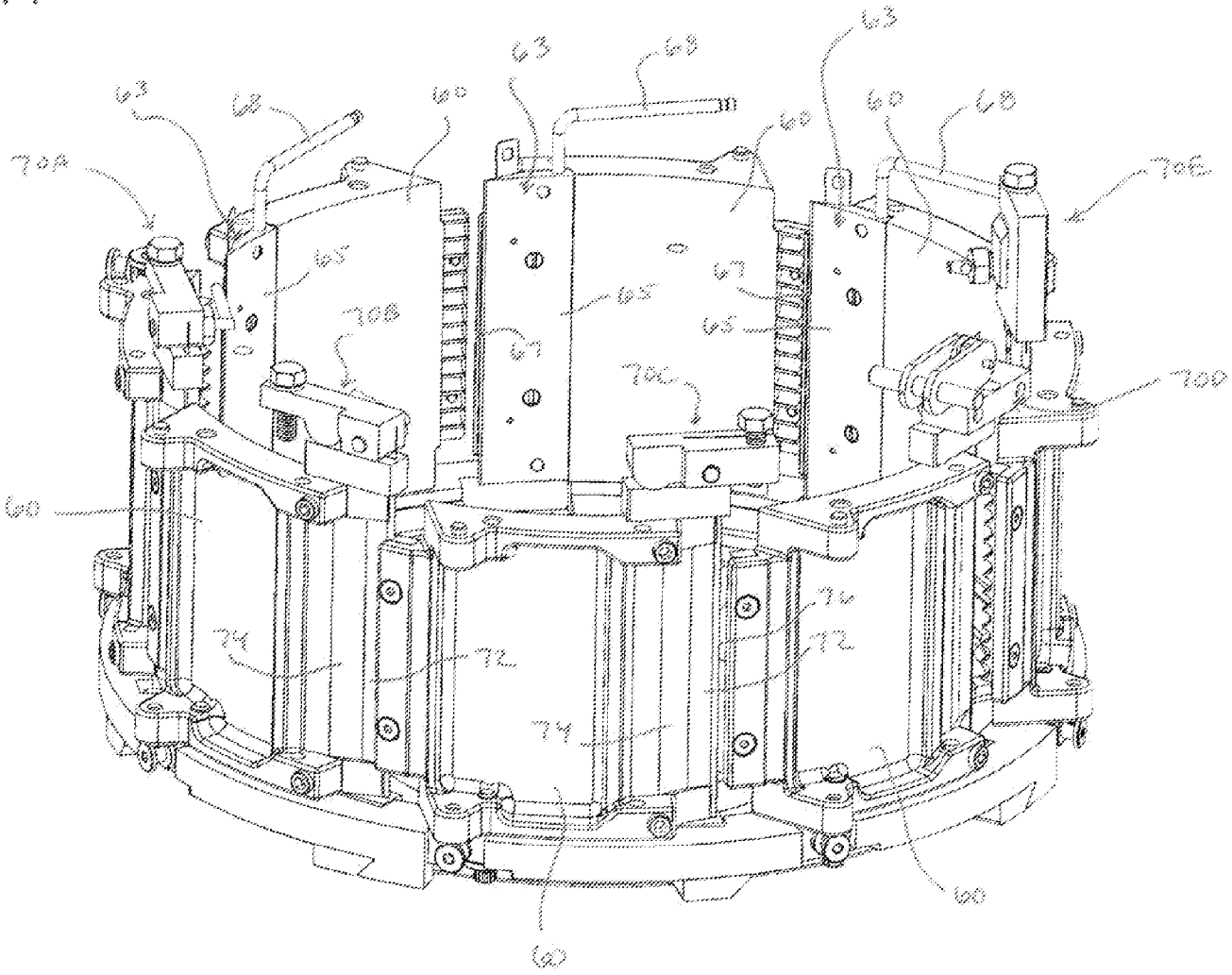
FIG. 7 is a perspective view showing the cutting header of FIG. 4 without the impeller and without an upper support ring of the cutting head.

Whereas FIGS. 4 and 5 show the cutting head 50 assembled with the impeller 52, FIG. 6 shows the cutting head 50 without the impeller 52 to provide a better view of the interior of the cutting head 50. The cutting head 50 shown in FIGS. 4-6 comprises a lower support ring 56, an upper support ring 58, and circumferentially-spaced support segments (shoes) 60 that are between and connected to the rings 56 and 58 and functionally similar to the shoes 22 of FIG. 3. Though the support rings 56 and 58 and shoes 60 are preferred components of the cutting head 50, it is foreseeable that other structural members capable of similar functions could be used in place of these components, and the support rings 56 and 58 and shoes 60 are not limited to the particular configurations shown in FIGS. 4 through 14. For illustrative purposes, FIG. 7 shows the cutting head 50 without the impeller 52 and upper support ring 58. The cutting head 50 is shown as further comprising multiple knife assemblies 62 and 63 spaced around the circumference of the cutting head 50 between adjacent pairs of shoes 60. For purposes of discussion, three knife assemblies 63 are represented as quick-clamping assemblies having a construction disclosed in U.S. Pat. Nos. 7,658,133 and 8,161,856, whose contents are incorporated herein by reference. The remaining five knife assemblies 62 differ from the knife assemblies 63, and it will become apparent from the discussion below that in practice the cutting head 50 would preferably utilize one or more of the knife assemblies 62.

Each of the three quick-clamping knife assemblies 63 includes a knife holder 65 (FIGS. 4 and 7) located adjacent an optional gate insert strip mounted to a corresponding one of the shoes 60. The insert strips are configured similarly to the strips 23 in FIG. 3, and precede each knife assembly 63 relative to the direction of rotation of the impeller 52 so that food product crosses the strip prior to encountering the knife assembly 63. A clamp 66 (FIG. 6) is mounted on the radially outward-facing side of a shoe 60 to clamp a knife 64 to the knife holder 65. With this configuration, and similar to the clamp assemblies 26 of FIG. 3, each pair of knife holder 65 and clamp 66 cooperate to clamp its respective knife 64 along most of the longitudinal length of the knife 64 between its longitudinal ends, with the result that only a portion of each knife 64 immediately adjacent its longitudinal cutting edge 67 is visible in FIGS. 4-7. The knife holders 65 and clamps 66 orient and secure the knives 64 so that the longitudinal length of each knife 64 extends between the support rings 56 and 58 adjacent an edge of an insert strip (or otherwise adjacent an edge of an adjacent shoe 60), and the cutting edge 67 of each knife 64 projects radially inward toward the impeller 52 in a direction generally opposite the direction of rotation of the impeller 52 such that the cutting edges 67 define the radially innermost extremities of the knives 64. Each knife assembly 63 further includes a securing means that includes a lever 68 for operating the clamp 66 to secure the knives 64 to the holders 66.

Figure 8:
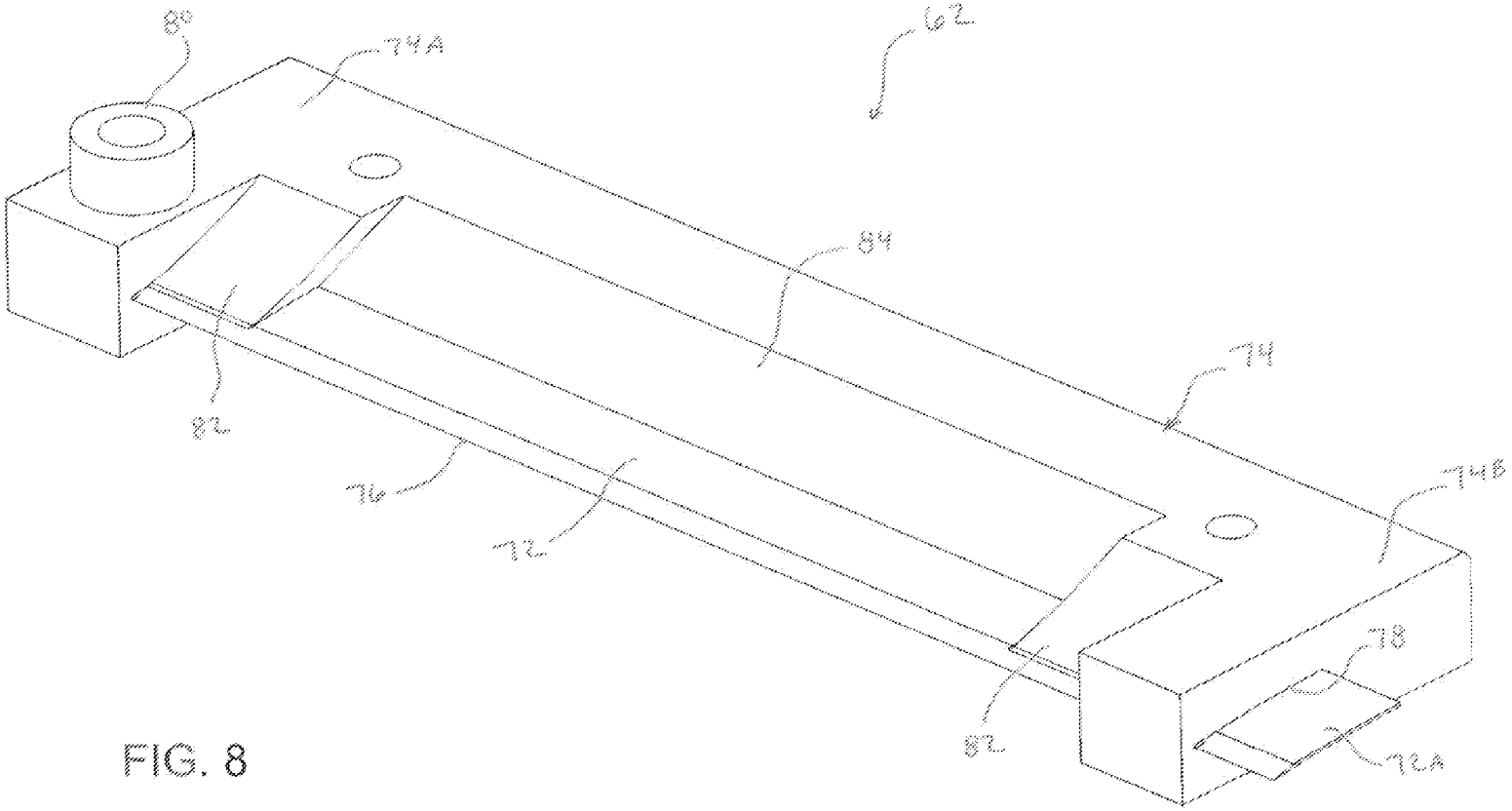
FIG. 8 is an isolated perspective view showing a knife assembly of the cutting header of FIG. 4.

As noted above, the remaining five knife assemblies 62 represented in FIGS. 4-7 are different from the knife assemblies 63 (as well as the assemblies 26 of FIG. 3). According to one aspect of the invention, the knife assemblies 62 differ as a result of lacking clamps 66 mounted on the radially outward-facing side of the cutting head 50. Instead, the knife assemblies 62 comprise tensioning means 70A-70E configured for adjustably tensioning knives 72. The knife assemblies 62 further comprise knife holders 74 that work in combination with the tensioning means 70A-70E (which may be collectively identified herein by the reference number 70). FIG. 8 represents a particular embodiment of a knife holder 74 that preferably differs from the knife holders 65 of the knife assemblies 63. The tensioning means 70 and knife holders 74 orient and secure the knives 72 so that the longitudinal length of each knife 72 extends between the support rings 56 and 58 adjacent an edge of an insert strip (or otherwise adjacent an edge of an adjacent shoe 60), and a longitudinal cutting edge 76 of each knife 72 projects radially inward toward the impeller 52 in a direction generally opposite the direction of rotation of the impeller 52 such that the cutting edges 72 define the radially innermost extremities of the knives 72.

As known in the art, food slicing machines, including the centrifugal-type slicer of FIG. 1, desirably have a relatively low rake-off angle to reduce the probability of slice damage. As used herein, the term "rake-off angle" is measured as the angle that a slice must deviate relative to a tangent line that begins at an intersection defined by the knife edge and a path of a product sliding surface defined by the interior surface of a leading shoe, i.e., the shoe immediately upstream of a particular knife. The line is then tangent to the radial product sliding surface of the leading shoe. The rake-off angle of the cutting head 12 represented in FIG. 3 is a function of both the hardware and the gap setting ("$d_{gap}$") at which the entire knife holder 26A, knife 14, and shoe 22 is positioned. Similarly, the rake-off angle associated with the knife assemblies 63 on the cutting head 50 represented in FIGS. 4-7 is also a function of both the gap setting at which the entire knife holder 65, knife 64, and shoe 60 is positioned. Because the clamps 66 of the knife assemblies 63 are mounted radially outward of the knife edge 67, the extent to which the rake-off angle associated with each knife assembly 63 can be minimized by reducing the radial thickness of the knife assembly 63 and its clamp 66. However, the extent to which the radial thickness of the knife assembly 63 can be reduced is limited by strength considerations, which must be sufficient for purposes of durability and/or inhibiting movement of the knife 64 during slicing.

According to a preferred aspect of the invention, the tensioning means 70 represented in FIGS. 4-7 are adapted for use in food slicing machines, including the centrifugal-type slicer of FIG. 1, while eliminating the need for clamping systems of the types similar to the assemblies 26 and 63, preferably with the result that slices exiting the knives 72 mounted by the tensioning means 70 are not subjected to a sufficient change in trajectory that would lead to bending or stressing of the food product that, in the case of potatoes and certain other starch food products, can lead to wedge stressing of the starch cells. By appropriately tensioning the knives 72 through tension applied through their longitudinal ends, the knives 72 can be effectively rendered sufficiently rigid to be able to cut through food products without necessitating clamping of the knives 72 along their entire lengths. Consequently, without the requirement for the clamps 66 utilized by the knife assemblies 63, the knife assemblies 62 are capable of having a much reduced radial profile that achieves a significantly lower rake-off angle.

Referring to FIG. 8, it can be seen that the knife holder 74 is fabricated to have a longitudinal internal slot 78 along its length that is complementarily sized and shaped to closely receive a knife 72. A lower end of the knife 72 is secured at the lower end 74A of the holder 74 (according to the orientation shown in FIGS. 4-7) with a fastener 80, whereas the opposite upper end 72A of the knife 72 protrudes from the slot 78 at the upper end 74B of the holder 74 to enable the exposed upper end 72A to be grasped, attached or otherwise connected to one of the tensioning means 70 to enable longitudinal tensioning of the knife 72 by the tensioning means 70. As seen in FIGS. 4-6, the upper end 74B of the holder 74 nests within a recess 88 in the radially inward perimeter of the upper support ring 58. In FIGS. 4 and 5, a similar recess 89 is shown as defined in the perimeter of the impeller 52 to allow for installation of the impeller 52 within the cutting head 50. In FIG. 6, the lower end 74A of the holder 74 is similarly configured to nest within a recess 91 in the radially inward perimeter of the lower support ring 56. As shown and later discussed in reference to FIG. 14, the slot 78 may have a transverse arcuate shape that creates in the knife 72 a transverse curvature whose radius preferably corresponds to the radially inward surface of the shoe 60 preceding the knife 72. Tension induced in the knife 72 permits its midportion, constituting a majority of the length of the knife 72, to be minimally supported by the knife holder 74. In the particular embodiment of FIG. 8, roughly one-half of the transverse width of the knife 72 opposite the cutting edge 76 is unsupported and not contacted by the knife holder 74 along a majority of the longitudinal length of the knife 74. To promote rigidity and stability at the cutting edge 76, the knife holder 74 is shown as having two flanges 82 contacting the knife 72 and extending toward the edge 76 adjacent opposite ends of the exposed portion of the edge 76. The region of the holder 74 between the flanges 82 defines a wedge 84 that defines a low radial profile over which slices produced by the knife 72 must pass as they exit the cutting head 50. The low radial profile of the wedge 84 achieves a significantly reduced rake-off angle for the knife assembly 62

For illustrative purposes, the tensioning means 70 represented in FIGS. 4-7 comprise five different embodiments 70A-70E, all within the scope of this invention. These five tensioning means 70A-70E are represented in greater detail in FIGS. 9 through 13, respectively, and will be discussed in further detail below.

Figure 9:
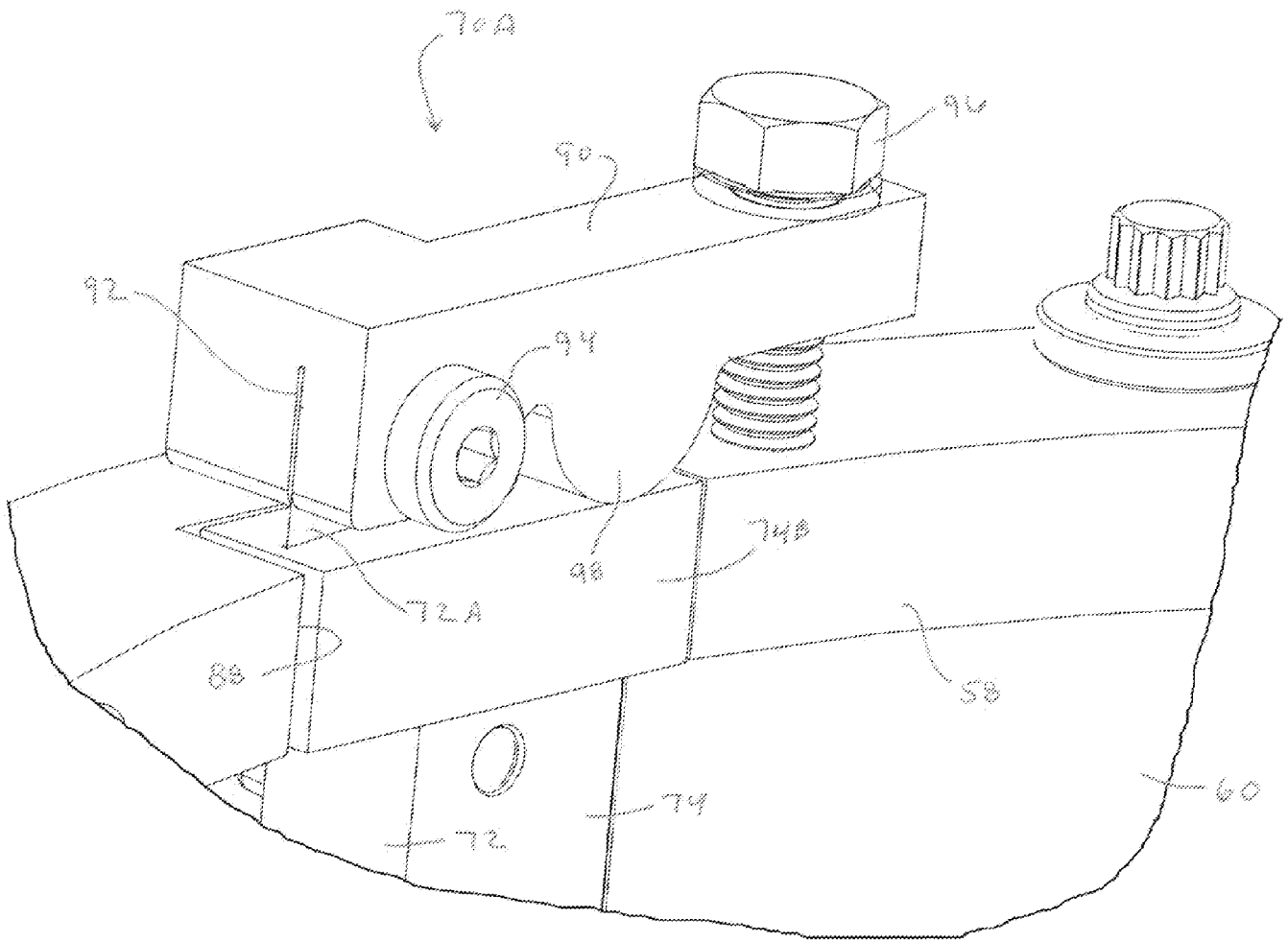
FIGS. 9 through 13 are perspective views individually showing five embodiments of the knife tensioning devices of the cutting header of FIG. 4.

As represented in FIG. 9, the tensioning means 70A is adapted to induce a longitudinal tension in the knife 72 through the cooperation of a rocker arm-type tensioning block 90, a slot 92 located at one end of the rocker arm-type tensioning block 90 and in which the upper end 72A of the knife 72 is received, a threaded pin 94 (or other suitable fastening means) that secures the upper end 72A of the knife 72 within the slot 92, a tensioning bolt 96 threaded into the upper support ring 58 of the cutting head 50, and a fulcrum 98 defined by the rocker arm-type tensioning block 90 between the pin 94 and tensioning bolt 96. By threading the fastener 96 into the support ring 58, the end of the block 90 opposite the knife 72 is drawn toward the ring 58 and, by the action of the fulcrum 98 against the upper surface of the upper support ring 58, the end of the block 90 to which the knife 72 is secured is rotated away from the ring 58 to induce longitudinal tension in the knife 72.

Figure 10:
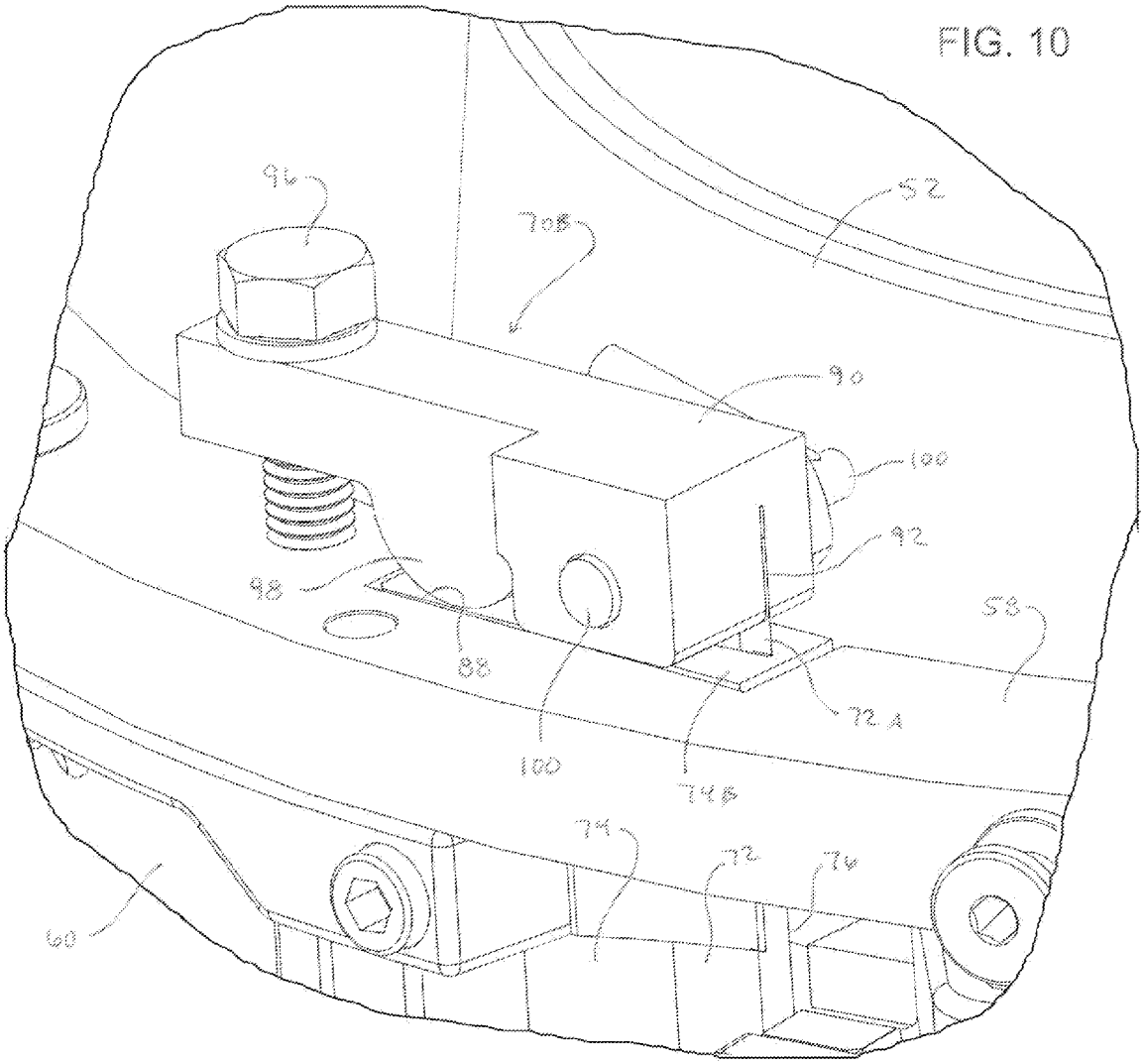

The tensioning means 70B represented in FIG. 10 comprises the same rocker arm-type tensioning block 90 as for the tensioning means 70A in FIG. 9, but replaces the threaded pin 94 with a spring-loaded pull pin 100 to secure the upper end 72A of the knife 72 within the slot 92.

Figure 11:
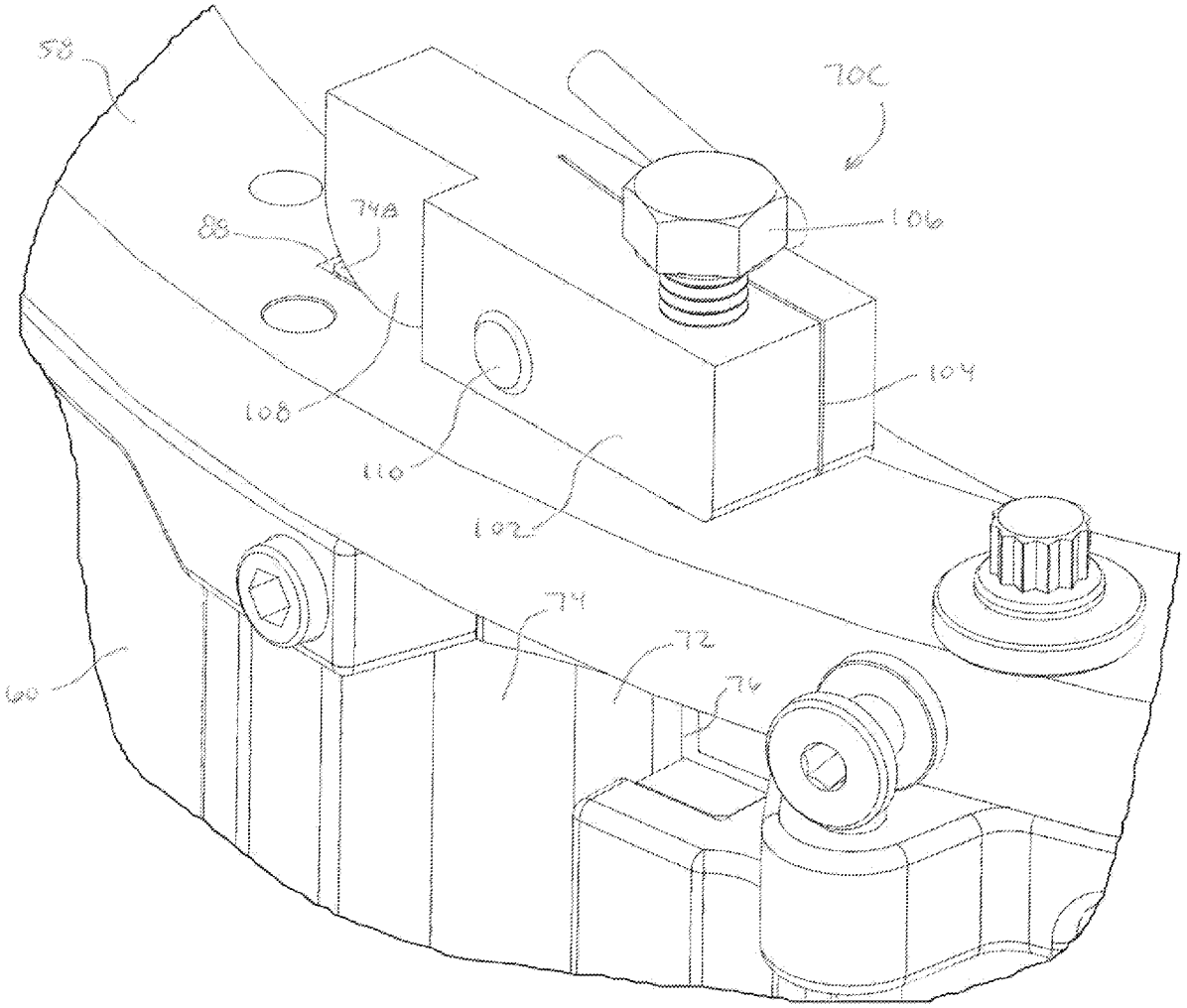

The tensioning means 70C represented in FIG. 11 comprises a one-sided rocker arm block 102. Similar to the previous embodiments, the block 102 comprises a slot 104 in which the upper end 72A of a knife 72 is received. A spring-loaded pull pin 110 (or other suitable fastening means) secures the upper end 72A of a knife 72 within the slot 104, a tensioning bolt 106 is threaded through one end of the block 102 and into the upper support ring 58 of the cutting head 50, and a fulcrum 108 is defined by the block 102 at an end of the block 102 opposite the tensioning bolt 106 and knife 72, such that the knife 72 is between the fulcrum 108 and bolt 106. By threading the fastener 106 into the block 102 to engage the support ring 58, the end of the block 102 to which the knife 72 is secured is rotated away from the ring 58 and, by the action of the fulcrum 108 against the upper surface of the upper support ring 58, longitudinal tension is induced in the knife 72.

Figure 12:
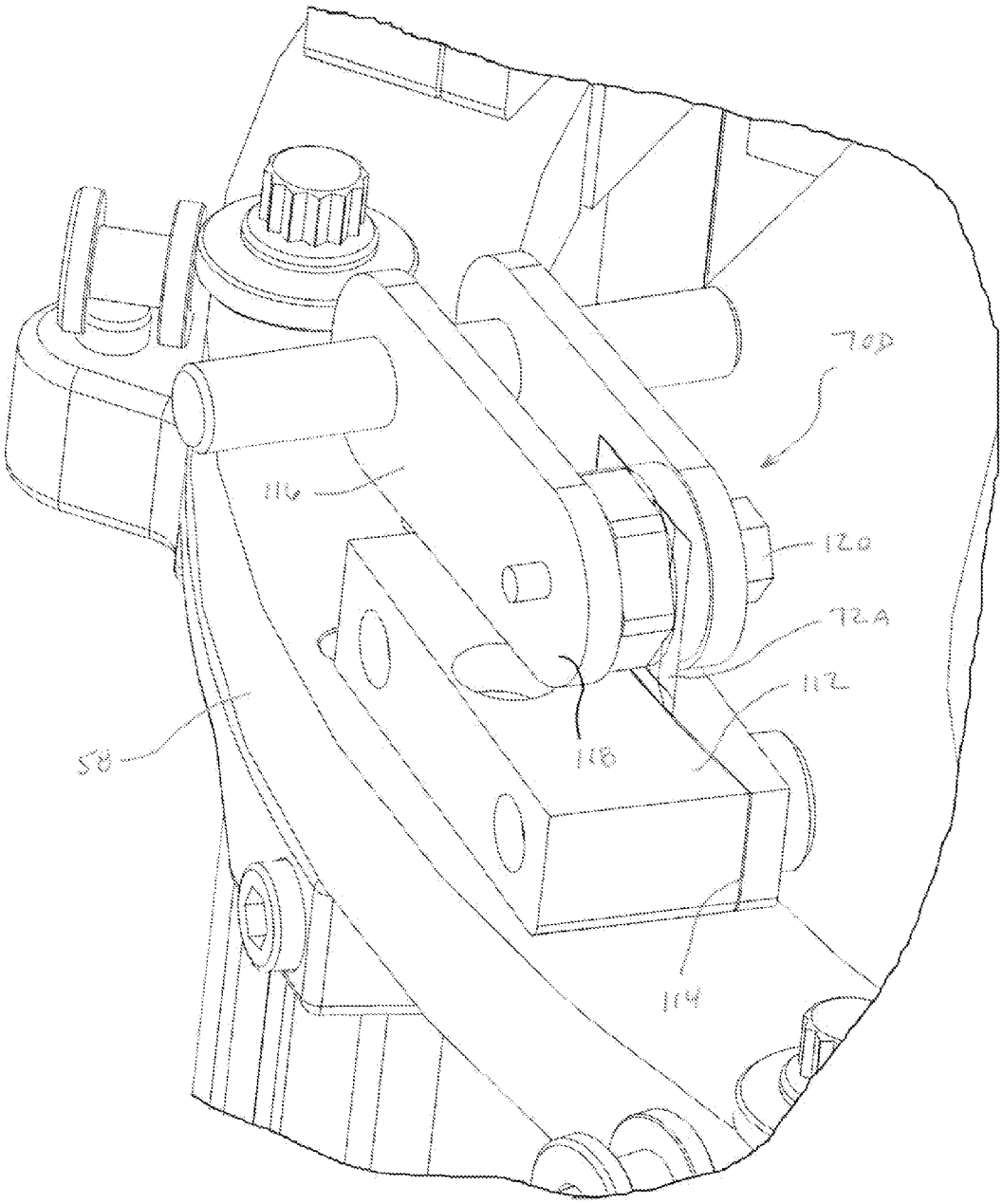

The tensioning means 70D represented in FIG. 12 comprises a squeeze block 112 to which a toggle clamp arm 116 is pivotally secured with a pin 120. Similar to the previous embodiments, the block 112 comprises a slot 114 located at one end thereof in which the upper end 72A of a knife 72 is received. The pin 120 passes through one end 118 of the toggle clamp arm 116, which is rounded and contoured as a cam such that, by rotating the arm 116 from a vertical orientation (not shown) to the horizontal orientation shown in FIG. 12, the end 118 of the arm 116 cams against the surface of the block 112 to pull the knife 64 upward and induce longitudinal tension in the knife 72.

Figure 13:
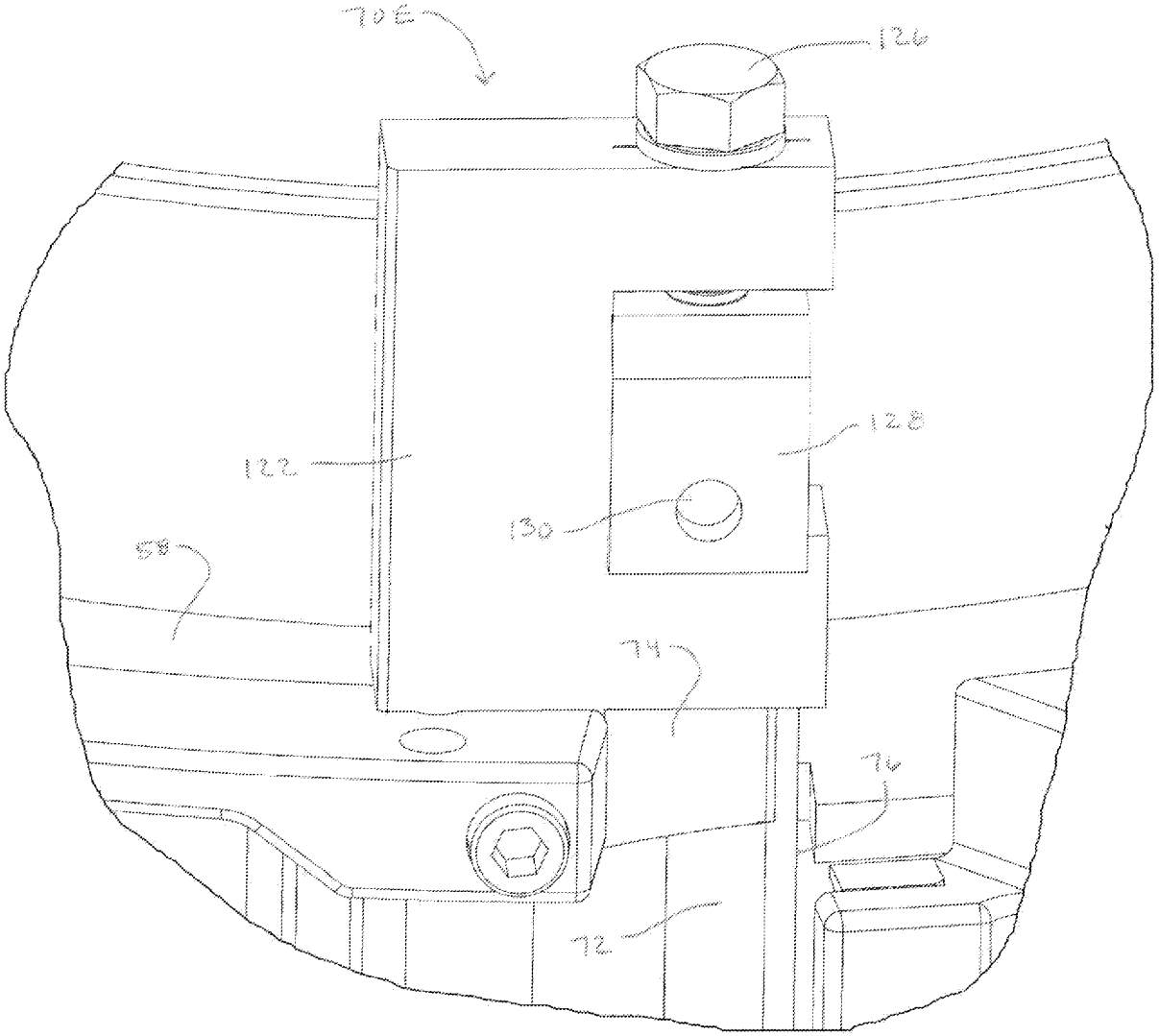

Finally, the tensioning means 70E represented in FIG. 13 comprises a C-shaped block 122 defining a recess in which a pull block 128 is disposed. The upper end 72A of a knife 72 is received within a slot 124 (FIG. 6) in the pull block 128. A spring-loaded pull pin 130 similar to that of FIGS. 10 and 11 (or other suitable fastening means) may be used to secure the upper end 72A of a knife 72 within the slot 124. A fastener 126 is threaded through the upper end of the C-shaped block 122 and into the pull block 128, such that the fastener 126 can be used to draw the pull block 128 upward and induce longitudinal tension in the knife 72.

Figure 14:
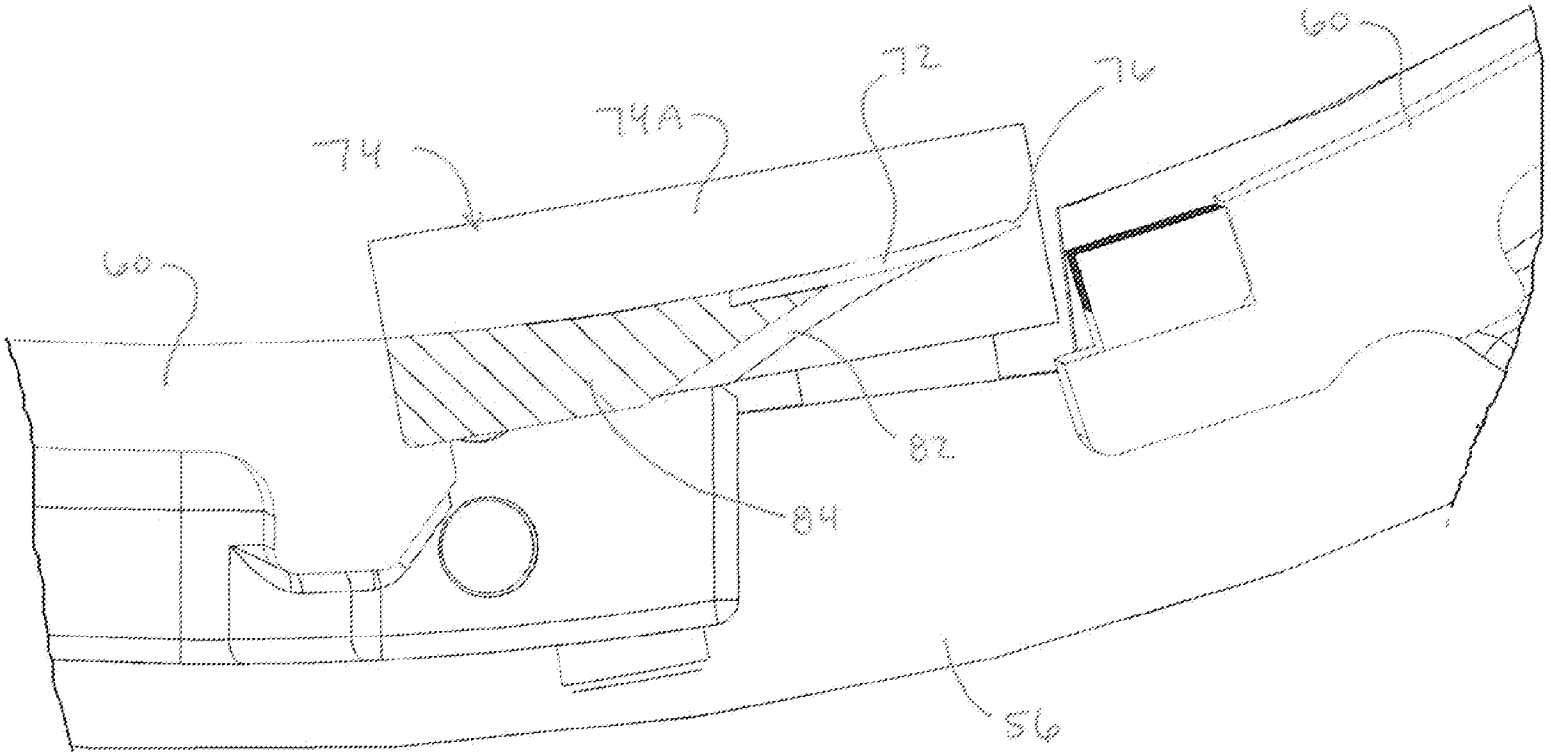
FIG. 14 is a cross-sectional view of a knife assembly of the cutting head of FIG. 4.

FIG. 14 is a cross-sectional view through one of the knife holders 74 mounted within the cutting head 50 and looking downward toward the lower support ring 56. FIG. 14 evidences a greatly reduced rake-off angle achievable as a result of the low radial profile of the wedge 84 in the absence of a clamp on the radially outward face of the holder 74. FIG. 14 also evidences the aforementioned transverse curvature of the slot 78 as creating in the knife 72 a curvature whose radius is approximately equal to the curvature of the radially inward surface of its leading shoe 60.

Technical aspects of the invention include that, in the absence of a conventional clamp (for example, the clamps 66 of the knife assemblies 63), the knife holder 74 and tensioning means 70 are able to cooperate to provide the sole backing and support for the knives 72, and the rake-off angle is established only by the knife cutting edge 76 (and any bevel thereof) and the wedge 84 of the knife holder 74 (FIG. 13). The tensioning means 70 can be used in combination with various knife configurations, including but not limited to knives 72 with widths of about ⅜ inch to 1.25 inch, and various thicknesses as might be desired or necessary to keep the thicker profile of the knife holder wedge 84 outside the slice path to lessen/eliminate micro(surface)cracking, resulting in reduced oil consumption during frying, reduced starch losses, reduced incidence of breakage, etc.

While the invention has been described in terms of specific embodiments, it is apparent that other forms could be adopted by one skilled in the art. For example, the impeller 52 and cutting head 50 could differ in appearance and construction from the embodiments shown in the Figures, the functions of each component of the impeller 52 and cutting head 50 could be performed by components of different construction but capable of a similar (though not necessarily equivalent) function, and various materials and processes could be used to fabricate the impeller 52 and cutting head 50 and their components. Therefore, the scope of the invention is to be limited only by the following claims.

The invention claimed is:

1. An apparatus for cutting food product, the apparatus comprising an annular-shaped cutting head and an impeller coaxially mounted within the cutting head for rotation about an axis of the cutting head in a rotational direction relative to the cutting head, the impeller having paddles for engaging and directing food products within the apparatus, the cutting head comprising:
   - lower and upper structural members;
   - circumferentially-spaced support segments between the lower and upper structural members; and
   - at least one knife assembly located at a perimeter of the cutting head adjacent a leading edge of a corresponding one of the support segments, the knife assembly comprising a holder having a slot, a knife partially received within the slot, and tensioning means for inducing a longitudinal tension in the knife;
   - wherein the paddles of the impeller are configured to direct the food products against a cutting edge of the knife;
   - wherein the holder comprises a midportion supporting a majority of a longitudinal length of the knife and supporting approximately a first half of a transverse width of the knife opposite the cutting edge, and a second half of the transverse width of the knife is unsupported and not contacted by the holder along the majority of the longitudinal length of the knife.

2. The apparatus according to claim 1, wherein the knife holder comprises lower and upper ends disposed adjacent, respectively, the lower and upper structural members of the cutting head, the knife has a lower end secured at the lower end of the knife holder, and the knife has an upper end protruding from the slot at the upper end of the holder and attached to the tensioning means.

3. The apparatus according to claim 1, wherein the slot of the holder has a transverse arcuate shape that creates in the knife a transverse curvature.

4. The apparatus according to claim 3, wherein the corresponding support member has a radially inward surface having a curvature equal to the transverse curvature of the knife.

5. The apparatus according to claim 1, wherein the holder defines a wedge disposed in the midportion thereof that defines a radial profile over which slices produced by the knife pass as the slices exit the cutting head.

6. The apparatus according to claim 1, wherein the tensioning means comprises:
   - a block disposed at the upper structural member and to which an end of the knife is secured; and
   - means for rotating the end of the knife away from the upper structural member to induce the longitudinal tension in the knife.

7. The apparatus according to claim 6, wherein the rotating means comprises a fulcrum and a fastener threadably engaged with the upper structural member.

8. The apparatus according to claim 7, wherein the fulcrum is between the knife and the fastener.

9. The apparatus according to claim 7, wherein the knife is between the fulcrum and the fastener.

10. The apparatus according to claim 1, wherein the tensioning means comprises:
   - a block disposed at the upper structural member and in which an end of the knife is received; and
   - a toggle arm operable as a cam such that the longitudinal tension is induced in the knife by rotating the toggle arm.

11. The apparatus according to claim 1, wherein the tensioning means comprises:

a block disposed at the upper structural member and in which an end of the knife is received; and a fastener threaded into the block and adapted to pull the end of the knife away from the upper structural member to induce the longitudinal tension in the knife.

12. The apparatus according to claim 1, wherein the knife assembly lacks any means located radially outward from the holder for clamping the knife against the holder.

13. The apparatus according to claim 1, wherein the apparatus is a food slicing machine.

14. The apparatus according to claim 1, wherein the apparatus is a centrifugal type food slicing machine.

15. A method of operating the apparatus of claim 1 to cut food products, the method comprising:

rotating the impeller within the cutting head;

introducing a food product to the impeller; and slicing the food product with the knife to produce slices that exit the cutting head by passing over a radial profile defined by the holder.

16. The method according to claim 15, wherein the holder defines a wedge disposed in a midportion thereof that defines the radial profile over which the slices produced by the knife pass as the slices exit the cutting head.

17. The apparatus according to claim 1, wherein the annular-shaped cutting head is configured to remain stationary during operation of the apparatus.

* * * * *